US005545066A

United States Patent [19]

Tsai

[11] Patent Number: 5,545,066

[45] Date of Patent: Aug. 13, 1996

[54] SWIMMING AID ASSEMBLY

[76] Inventor: Yen-Wen Tsai, 144, Lane 509, Pei Tun Road, Taichung, Taiwan

[21] Appl. No.: 511,734

[22] Filed: Aug. 7, 1995

[51] Int. Cl.[6] ..... A63B 31/11

[52] U.S. Cl. ..... 441/61

[58] Field of Search ..... 441/61–64

[56] References Cited

U.S. PATENT DOCUMENTS

| | | | |
|---|---|---|---|
| 1,878,916 | 9/1932 | Trujillo | 441/63 |
| 3,952,351 | 4/1976 | Gisbert | 441/64 |
| 5,125,860 | 6/1992 | Tsai | 441/64 |

*Primary Examiner*—Jesus D. Sotelo

[57] ABSTRACT

A swimming aid assembly comprises a generally grid-shaped frame with transverse bars and longitudinal rods. Each transverse bar connects a leaf. The reinforced ribs are disposed on the frame. A first retaining ring is at an end of the toe strap. A longitudinal instep strap and a longitudinal first heel strap are crossed by a first cross strap. The first heel strap is at an end portion of the first cross strap upward. The longitudinal instep strap and a longitudinal second heel strap are crossed by a second cross strap. The second heel strap is at a middle portion of second cross strap downward. The first cross strap is at an end portion of the instep strap. The second cross strap is at a center portion of the instep strap. A second retaining ring is at an end of the instep strap. A third retaining ring is at an end of the first cross strap.

6 Claims, 9 Drawing Sheets

SWIMMING AID ASSEMBLY

BACKGROUND OF THE INVENTION

The invention relates to a swimming aid assembly. More particularly, the invention relates to a swimming aid assembly which has adjustable straps to fit a barefoot and various diving boots very well.

U.S. Pat. No. 5,125,860 discloses a flipper assembly which contains two pairs of straps or a strap of a sandal. If the straps are too long, the tying straps may stumble the user while the user is walking along the beach, coast or shore. If the user is stumbled on the rocky coast, the injury of the user may be serious. Further, the longer straps will enter the mesh of the frame so that the leaves cannot function very well. If the straps can just fit a barefoot, then the straps are too short for a diving boot. The dilemma of either providing longer straps or providing shorter straps cannot be solved by the conventional fins, flippers and swimming aid devices. U.S. Pat. No. 3,952,351 discloses a swimming aid device which has a sandal with a plurality of thongs thereon. The thongs cannot be adjusted to fit a barefoot at one time and a diving boot at another time. If a sandal can fit a barefoot, it cannot fit a diving boot. If the sandal can fit a diving boot, it cannot fit a barefoot. Since the sizes of diving boots are not enlarged by multiplying the size of the barefoot in all directions, it is very difficult to make adjustable straps to fit a barefoot at one time and diving boots at other times.

SUMMARY OF THE INVENTION

An object of the invention is to provide a swimming aid assembly which contains adjustable straps to fit a barefoot at one time and various diving boots at other times.

Another object of the invention is to provide a swimming aid assembly which contains adjustable straps to be easily replaced while one of the straps is broken.

The comparison of the present invention and the conventional swimming aid devices is in the following paragraph.

If the straps of the conventional swimming aid devices or the fastening buckles of the conventional flippers are broken, the flippers or swimming aid devices become useless. However, the straps of the present invention can be replaced easily if the straps are broken. In general, there are two types of conventional swimming aid devices which comprises fins, flippers and other swimming aid devices. The first type of swimming aid devices fit barefeet only. The second type of swimming aid devices fit diving boots only. However, the present invention provides a swimming aid assembly to fit both barefoot and various diving boots without changing the above-identified swimming aid assembly.

Accordingly, a swimming aid assembly comprises a generally grid-shaped frame with spaced transverse bars and spaced longitudinal rods to form a plurality of meshes. Each of the transverse bar connects a transverse leaf. At least a first and second reinforced ribs are disposed transversely and spacedly on the generally grid-shaped frame. A hook and loop type toe strap is disposed adjacent to the second reinforced rib. A first fastener member is disposed at an end of the hook and loop type toe strap. A longitudinal hook and loop type instep strap and a longitudinal first heel strap are crossed by a first hook and loop type cross strap. The first heel strap is disposed at an end portion of the first cross strap. The longitudinal hook and loop type instep strap and a longitudinal second heel strap are crossed by a second hook and loop type cross strap. The second heel strap is disposed at approximately a middle portion of second cross strap. The first cross strap is disposed at an end portion of the instep strap. The second cross strap is disposed approximately at a center portion of the instep strap. A second fastener member is disposed at an end of the instep strap. A third fastener member is disposed at an end of the first cross strap. The instep strap is disposed adjacent to the first reinforced rib. The first and second heel straps are positioned by the corresponding longitudinal rods, respectively.

DETAILED DESCRIPTION OF THE INVENTION

Figure 1:
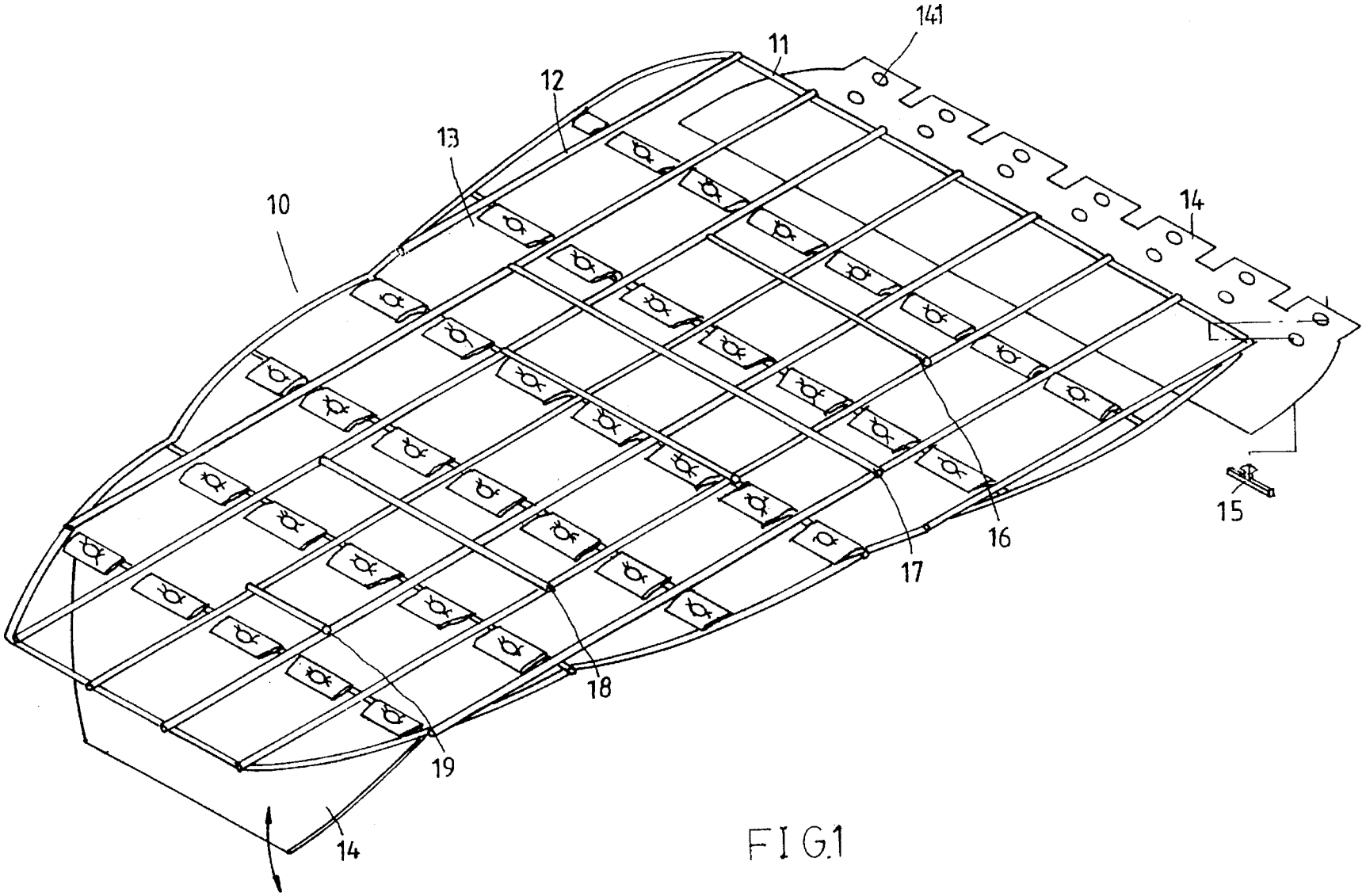
FIG. 1 is a perspective assembly view of a swimming aid assembly without the adjustable straps in accordance with the invention.

Referring to FIG. 1, a generally grid-shaped frame 10 of a swimming aid assembly contains a plurality of spaced transverse bars 11 and a plurality of spaced longitudinal rods 12. The crisscross of the transverse bars 11 and the longitudinal rods 12 forms a generally grid-shaped frame 10 with a plurality of meshes 13. Each transverse bar 11 connects a transverse leaf 14. The width of the leaf 14 is approximately the same as the space between two transverse bars 11. Each leaf 14 has two rows of holes 141 to be positioned by the corresponding buttons 15 which are disposed on the transverse bars 11.

Figure 2:
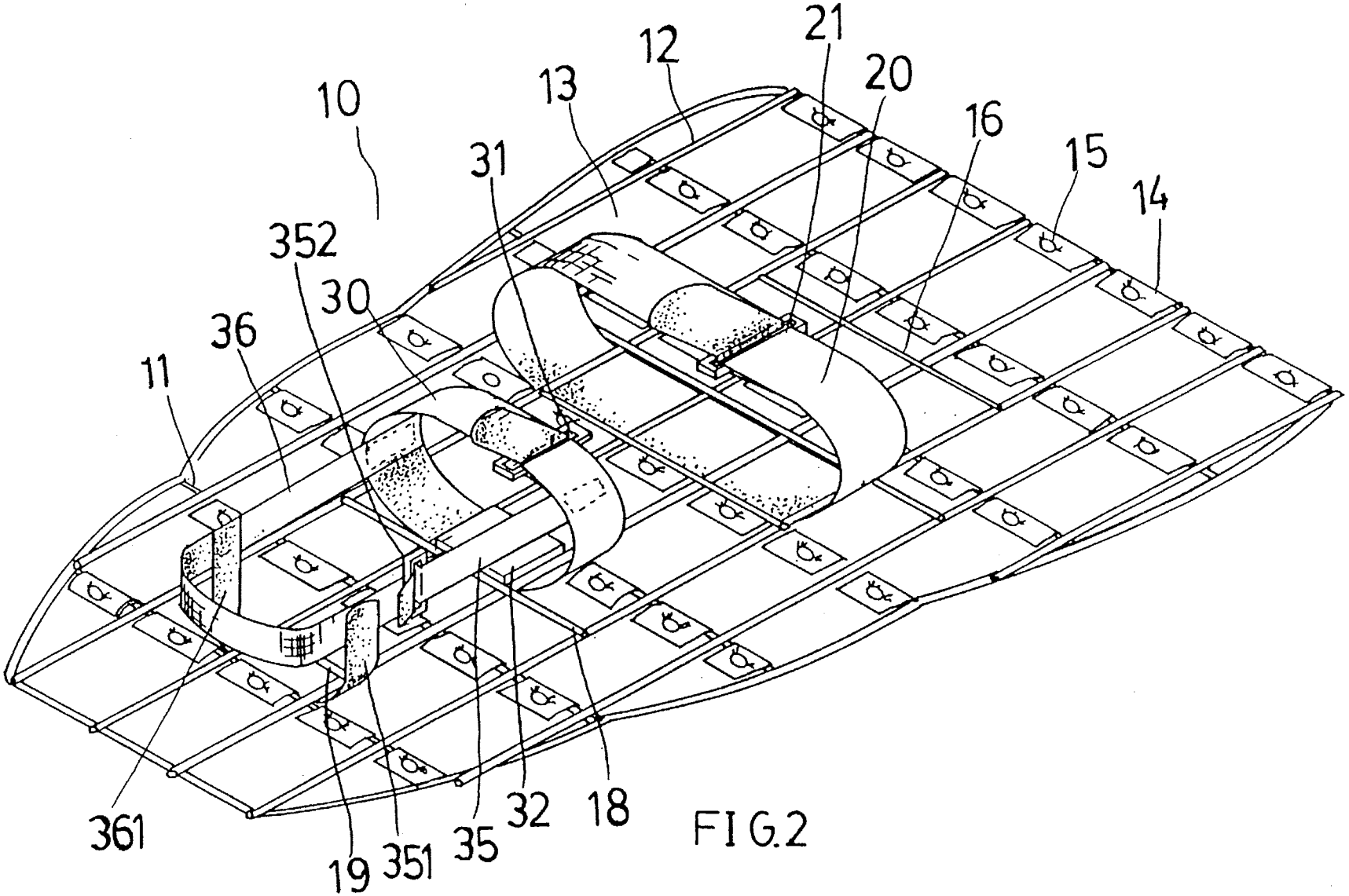
FIG. 2 is a perspective assembly view of a swimming aid assembly with the adjustable straps in accordance with the invention.

Referring to FIGS. 1 and 2, the first, second, third and fourth reinforced ribs 19, 18, 17 and 16 are disposed transversely and spacedly on the grid-shaped frame to support the foot of the user and to position the corresponding adjustable straps which will be described later. The positions of the reinforced ribs 19, 18 and 17 are disposed according to the positions of the adjustable straps. The adjustable straps comprise a separated toe strap 20 and a connected strap which contains an instep strap 30, a first and second heel straps 351 and 361, and a first and second cross straps 35 and 36. The adjustable strap is made of hook and loop type fastener (Velcro fastener or Magic Tape) which has a male tape such as a hook tape and a female tape such as a loop tape. Each strap 20, 30, 351, 361 and 36 has a hook tape 20B, 30B, 351B, 361B, and 36B and a loop tape 20A, 30A, 351A, 361A and 36A, respectively.

The position of each hook tape and the corresponding loop tape can be exchanged as a various embodiment of the present invention.

Figure 3:
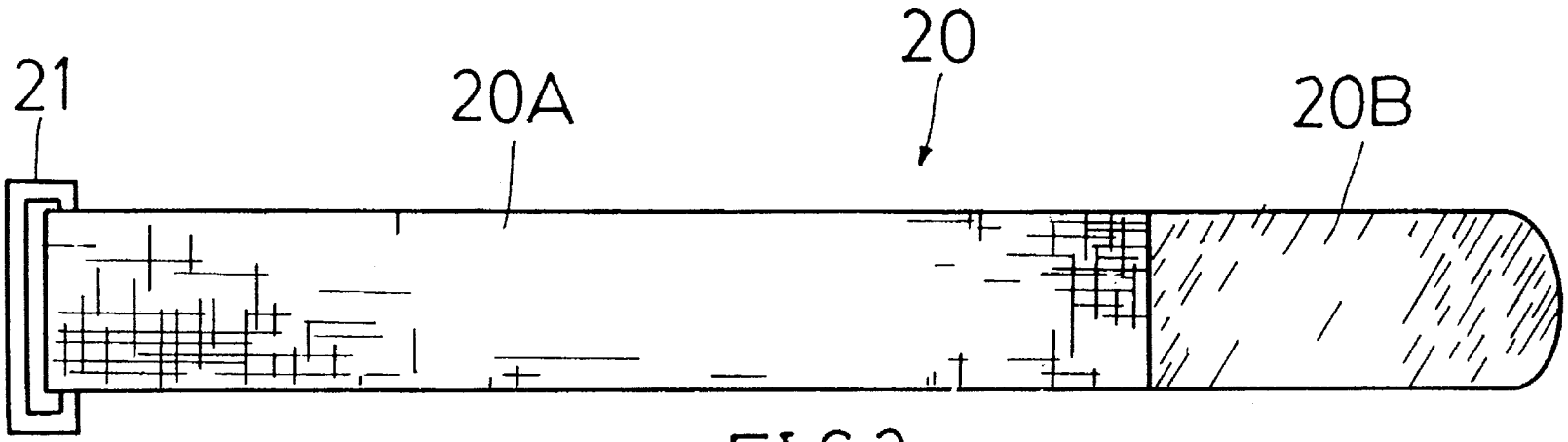
FIG. 3 is a plan view of a toe strap.

Referring to FIGS. 1 and 2 again, a toe (toecap) strap 20 is disposed between the third reinforced rib 17 and a transverse bar 11. Referring to FIG. 3, one end portion of the toe strap 20 is a toe hook tape 20B and the rest of the toe strap 20 is a toe loop tape 20A. The toe strap 20 is formed by connecting a longer toe loop tape 20A and a shorter toe hook tape 20B. A first retaining ring 21 is disposed at one end of the toe strap 20.

Figure 4:
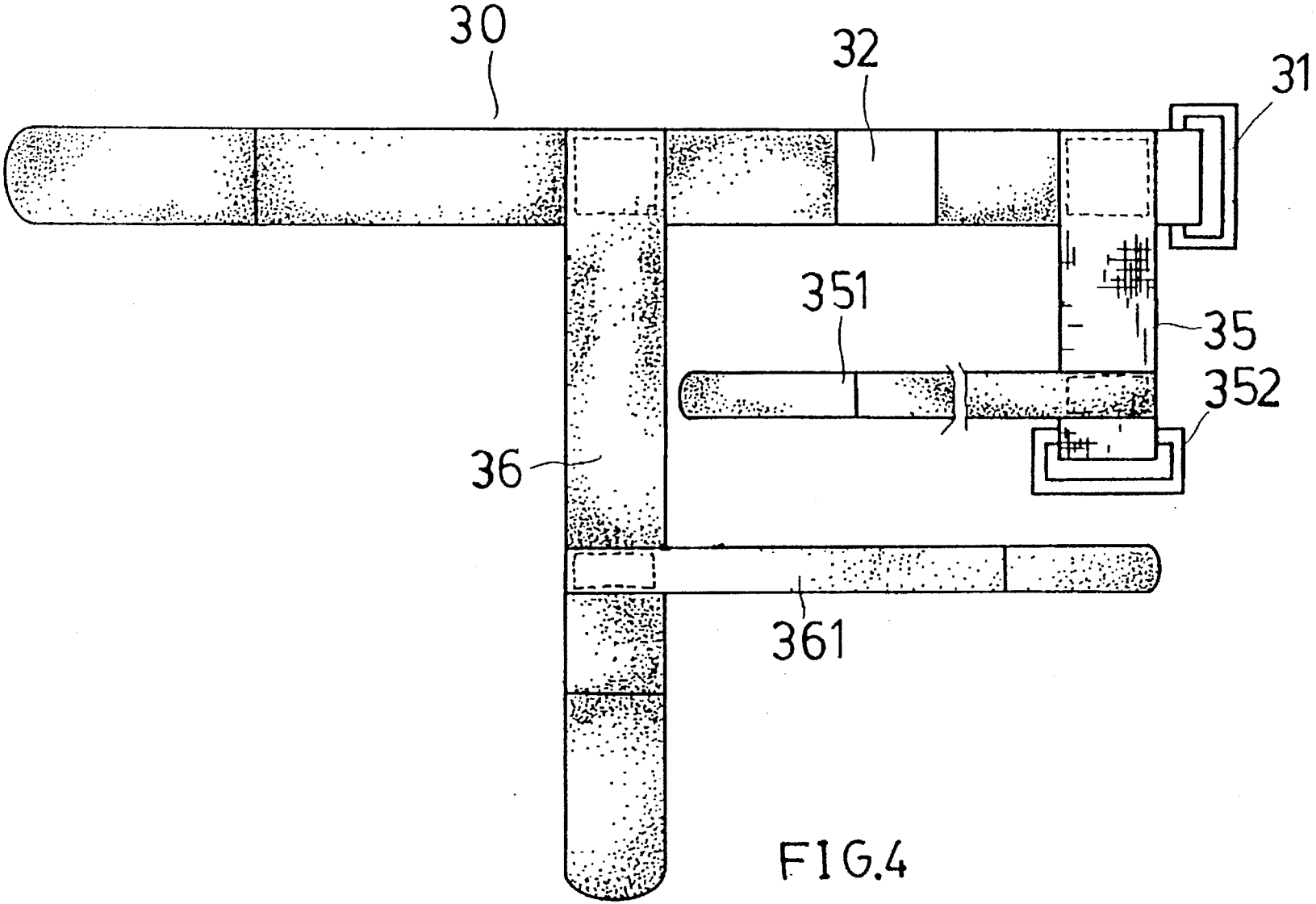
FIG. 4 is a front plan view of an instep strap, a first and second heel straps and a first and second cross straps.
Figure 4A:
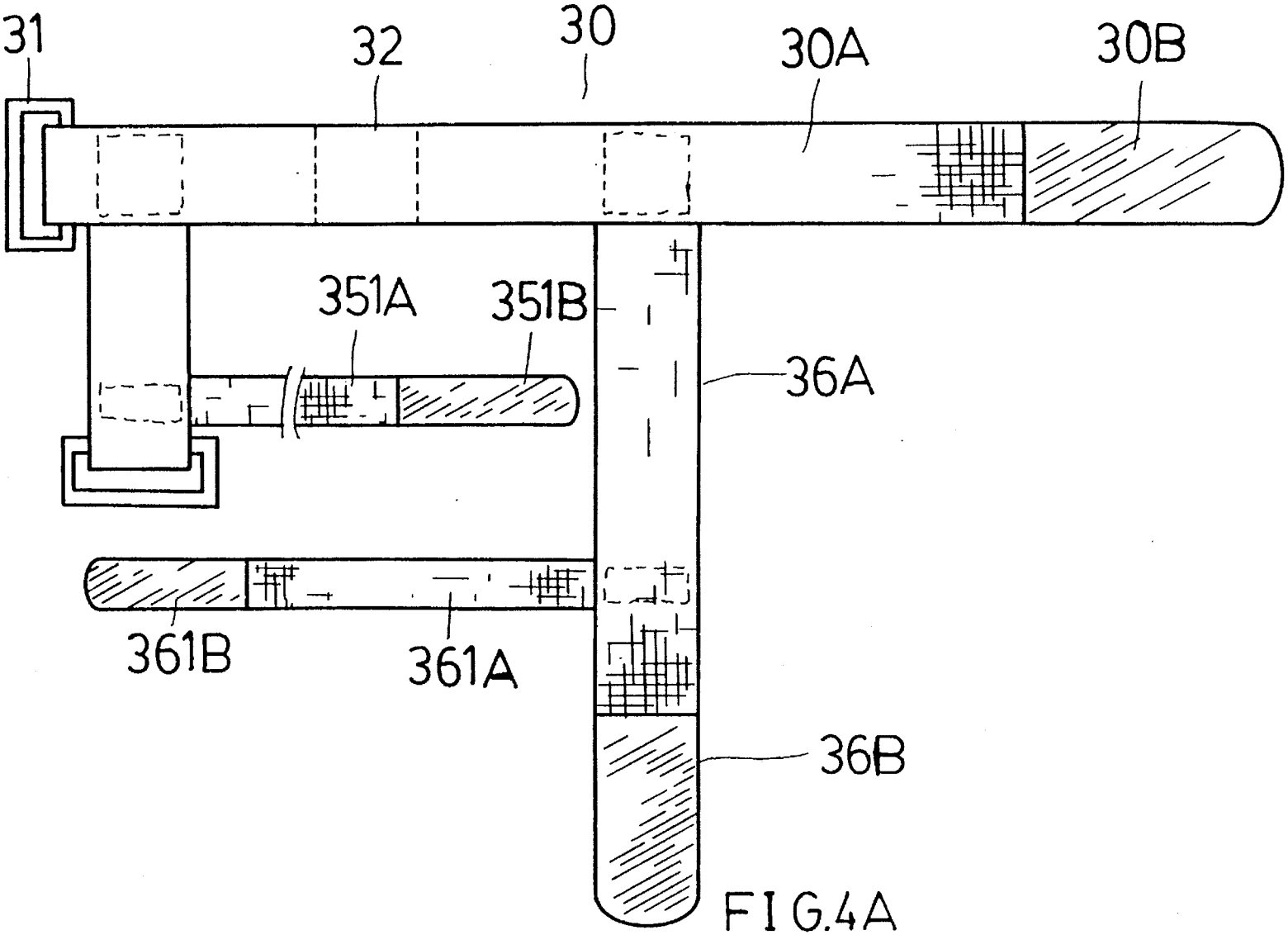
FIG. 4A is a rear plan view of FIG. 4.

Referring to FIGS. 2 and 4, a longitudinal instep (throat) strap 30 and a longitudinal first heel strap 351 are crossed secantly by a first cross strap 35. The longitudinal instep strap 30 and a longitudinal second heel strap 361 are crossed secantly by a second cross strap 36. One end of the first cross strap 35 is at the end portion of the instep strap 30. One end of the second cross strap 36 is approximately at the center portion of the instep strap 30. The second retaining ring 31 is disposed at the terminal end of the instep strap 30. The third retaining ring 352 is disposed at the terminal end of the first cross strap 35. The first heel strap 351 is disposed at the end portion of the first cross strap 35 upward. The second heel strap 361 is disposed at approximately the middle portion of the second cross strap 36 downward. A positioning pad 32 is disposed at the lower portion of the instep strap 30 optionally. The positioning pad 32 is positioned between two longitudinal rods 12 and adjacent to the second reinforced rib 18. The instep strap 30 is positioned between the second reinforced rib 18 and a transverse bar 11. The first and second heel straps 351 and 361 are positioned by the corresponding longitudinal rods 12, respectively. Referring to FIG. 4A, the reverse side of the connected strap of FIG. 4 is illustrated. FIG. 4A shows the loop tapes 30A, 36A, 351A and 361A and the corresponding hook tapes 30B, 36B, 351B and 361B, respectively. The instep strap 30 has an instep hook tape 30B at an end portion and the rest of the instep strap 30 is an instep loop tape 30A. The first heel strap 351 has a first heel hook tape 351B at an end portion and the rest of the first heel strap 351 is a first heel loop strap 351A. The second heel strap 361 has a second heel hook tape 361B at an end portion and the rest of the second heel strap 361 is a second heel loop strap 361A. The second cross strap 36 has a second cross hook tape 361B at an end portion and the rest of the second cross strap 36 is a second cross loop tape 361A.

Figure 5A:
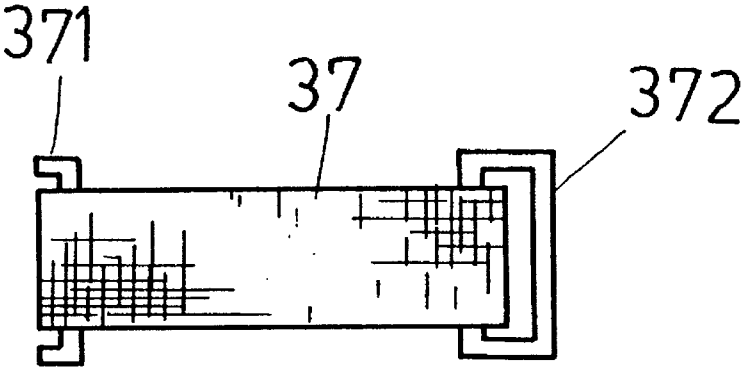
FIG. 5A is a partly plan view of an extended strap.
Figure 5:
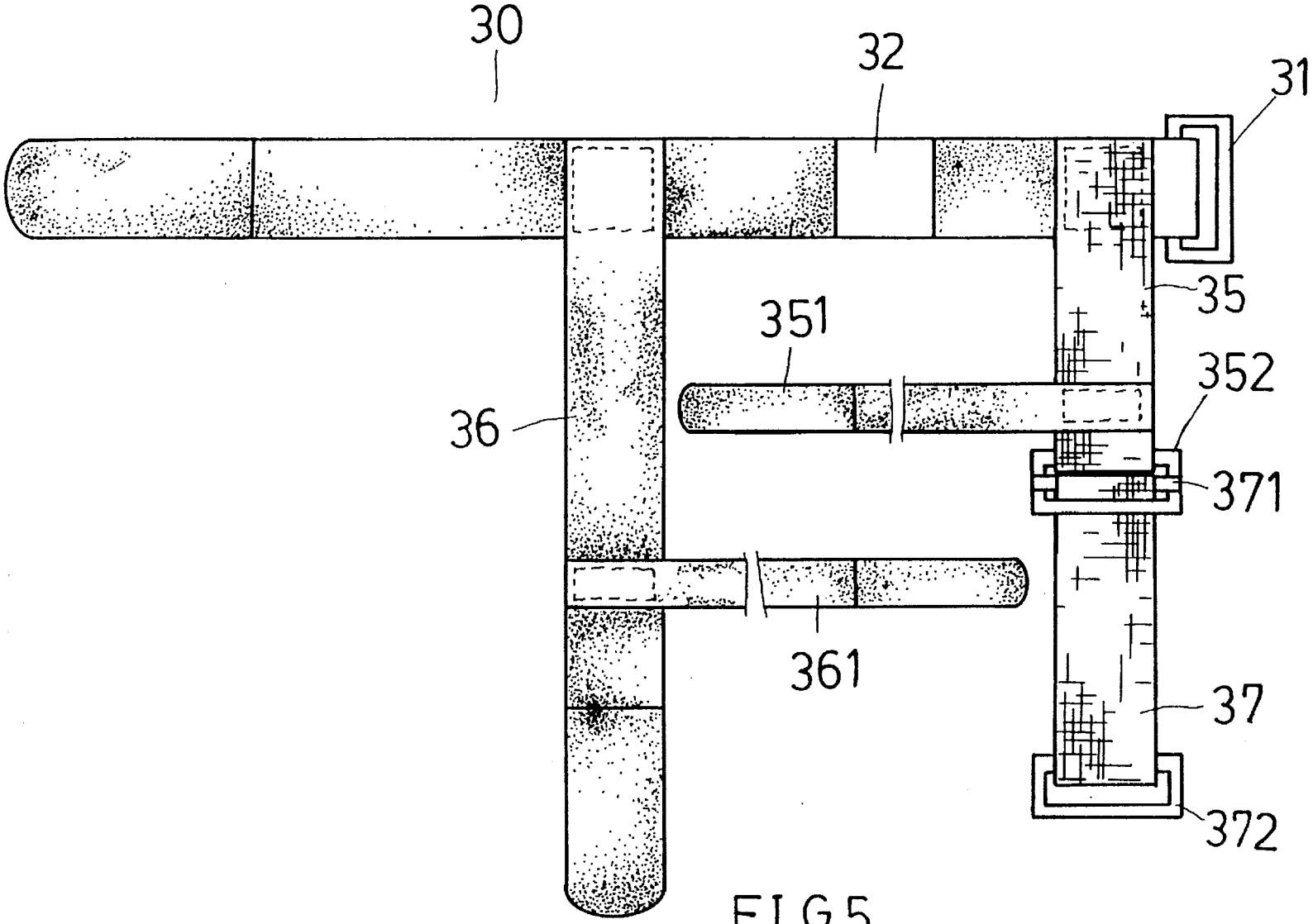
FIG. 5 is a front plan view of an instep strap, a first and second heel straps, a first and second cross straps and an extended strap.
Figure 5B:
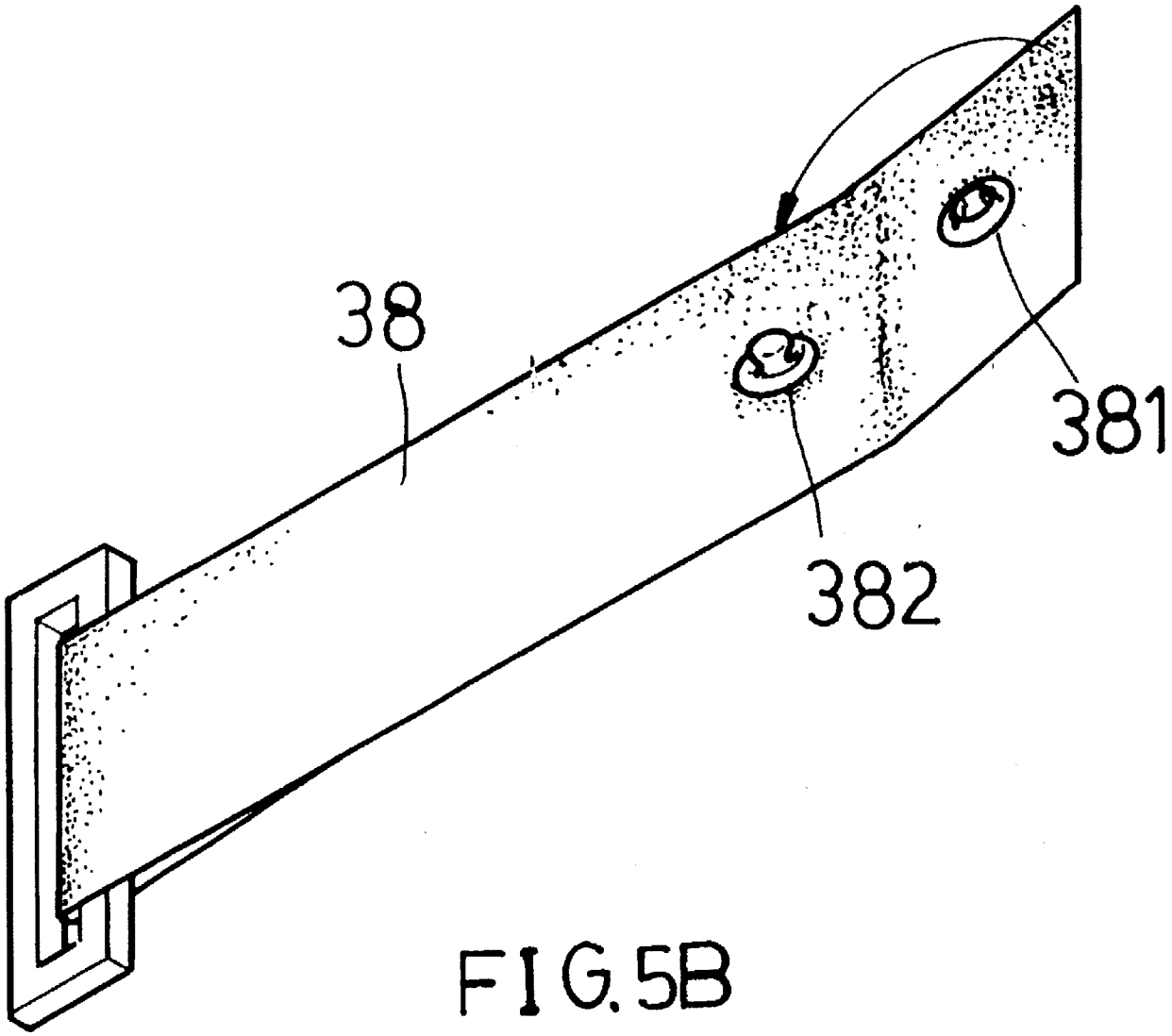
FIG. 5B is a perspective view of another extended strap.
Figure 7A:
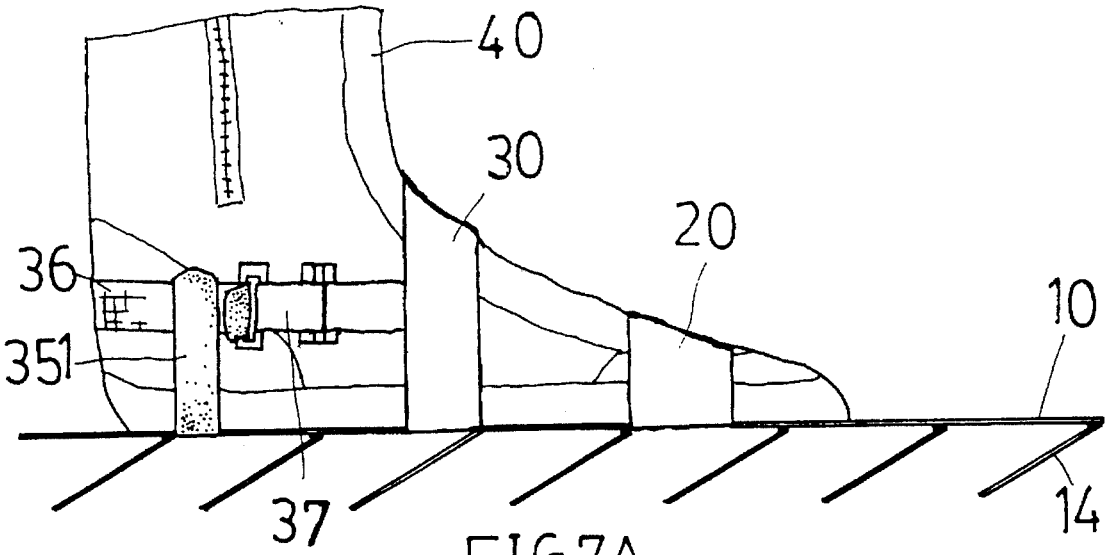
FIG. 7A is a plan view of binding a diving boot with the adjustable straps.

Referring to FIGS. 5, 5A and 7A, an optional extended cross strap 37 is connected to the third retaining ring 352 of the first cross strap 35. A cross rod 371 which is disposed at one terminal end of the extended strap 37 crosses the retaining ring 352. A fourth retaining ring 372 is disposed at the other terminal end of the extended strap 37. The extended strap 37 can also be connected to the first retaining ring 21 and the second retaining ring 31 to extend the toe strap 20 and the instep strap 30, respectively. When the user wears a diving boot, the user may need the extended straps 37 to bind different positions of the boot such as the toecap, the throat and the heel. The toecap of a boot is larger than the toe of a barefoot. The throat of a boot is much larger than the instep of a barefoot. Therefore, the extended straps 37 are necessary for the first cross strap 35, the throat strap 30 and the toecap strap 20. In an another embodiment, the extended strap 37 can be replaced by the extended strap 38 which has a female snap fastener (socket) 381 and a male snap fastener (stud) 382 as shown in FIG. 5B.

Figure 6:
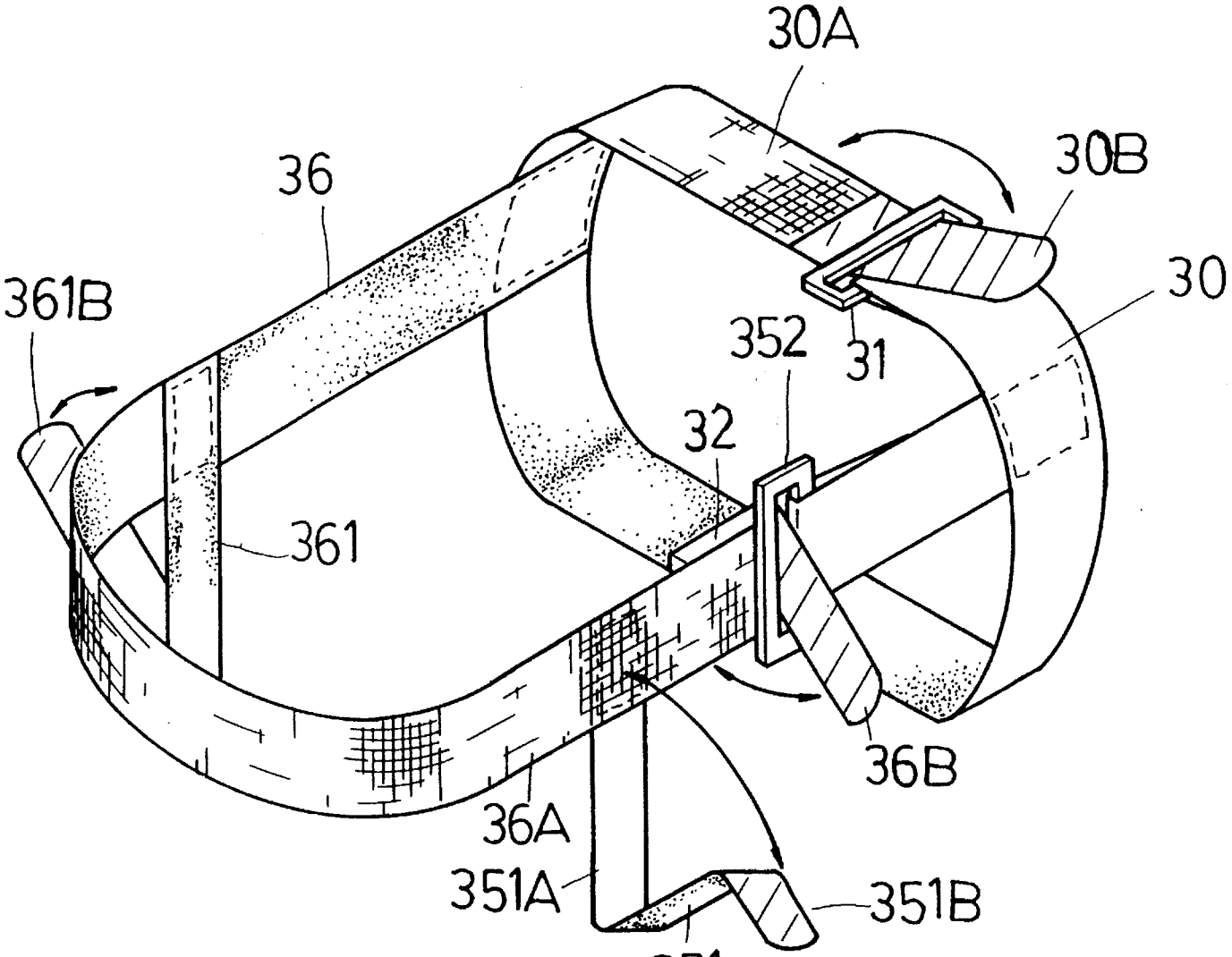
FIG. 6 is a schematic view illustrating the application of the adjustable straps in accordance with the present invention.
Figure 7B:
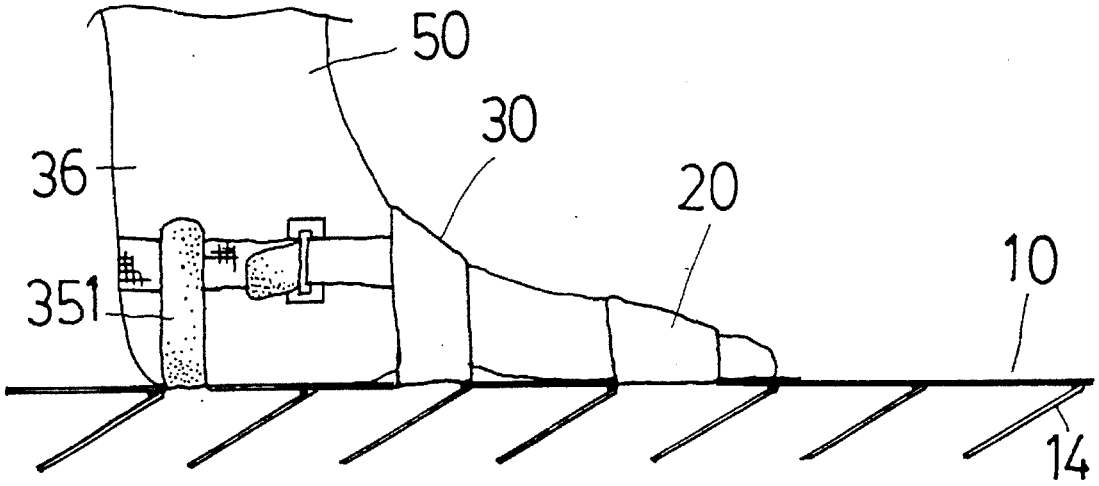
FIG. 7B is a plan view of binding a bareboot with the adjustable straps.

Referring to FIGS. 2, 6 and 7B, the toe hook tape 20B is inserted through the first retaining ring 21 until the toe strap 20 is tight in order to bind the toe (toecap) portion tightly. The toe hook tape 20B is turned over to press and fasten the toe loop tape 20A. The instep hook tape 30B is inserted through the second retaining ring 31 until the instep strap 30 is tight in order to bind the instep (throat) portion tightly. The instep hook tape 30B is turned over to press and fasten the instep loop tape 30A. The second cross hook tape 36B is inserted through the third retaining ring 352 (or the fourth retaining ring 372 in FIG. 7A) until the second cross strap 36 is tight in order to bind the ankle portion tightly. The second cross hook tape 36B is turned over to press and fasten the second cross loop tape 36A. Referring to FIGS. 7A and 7B again, the diving boot and the barefoot are fastened tightly so that the swimming aid assembly will not be loosened or removed from the diving boot and the barefoot.

The advantages of the invention are described as follows. Each adjustable strap can be extended by an extended strap so that the straps can be adjusted to fit various sizes of barefeet and diving boots. The various sized barefeet and diving boots can be fastened tightly and comfortably on the swimming aid assembly by the adjustable straps. Thus a single swimming aid assembly can fit various sized barefoot and diving boot under different conditions of swimming and diving, so the user need not prepare another pair of swimming aid assembly to fit the size of a barefoot or a diving boot. Further, the adjustable straps can be extended by one or two extended strap if they are too short. Moreover, the adjustable straps can be replaced by another strap if one of the adjustable straps is broken.

The invention is not limited to the above embodiments but various modification thereof may be made. It will be understood by those skilled in the art that various changes in form and detail may be made without departing from the spirit and scope of the invention.

What is claimed is:

1. A swimming aid assembly comprising:

a generally grid-shaped frame which has a plurality of spaced transverse bars and a plurality of spaced longitudinal rods to form a plurality of meshes thereon;

each of said transverse bar connecting a transverse leaf thereon;

at least a first and second reinforced ribs disposed spacedly and transversely on said generally grid-shaped frame;

a hook and loop type toe strap disposed adjacent to said second reinforced rib;

a first fastener member disposed at an end of said hook and loop type toe strap;

a longitudinal hook and loop type instep strap and a longitudinal first hook and loop type heel strap being crossed by a first hook and loop type cross strap;

said first heel strap disposed at an end portion of said first cross strap;

said longitudinal hook and loop type instep strap and a longitudinal second hook and loop type heel strap being crossed by a second hook and loop type cross strap;

said second heel strap disposed at approximately a middle portion of said second cross strap;

said first cross strap disposed at an end portion of said instep strap;

said second cross strap disposed approximately at a center portion of said instep strap;

a second fastener member disposed at an end of said instep strap;

a third fastener member disposed at an end of said first cross strap;

said instep strap disposed adjacent to said first reinforced rib;

said first and second heel straps being positioned by said corresponding longitudinal rods, respectively.

2. A swimming aid assembly as claimed in claim 1, wherein an extended strap is fastened to said first fastener member.

3. A swimming aid assembly as claimed in claim 1, wherein an extended strap is fastened to said second fastener member.

4. A swimming aid assembly as claimed in claim 1, wherein an extended strap is fastened to said third fastener member.

5. A swimming aid assembly as claimed in claim 2, 3 or 4, wherein said extended strap has a cross rod disposed at an end of said extended strap.

6. A swimming aid assembly as claimed in claim 1, 2, 3, or 4, wherein said fastener member is a retaining ring.

* * * * *